US007963127B2

(12) United States Patent
Stingel

(10) Patent No.: US 7,963,127 B2
(45) Date of Patent: Jun. 21, 2011

(54) NEEDLE-DRIVE KNOCK-OVER SINKER

(75) Inventor: Uwe Stingel, Messstetten (DE)

(73) Assignee: Goz-Beckert KG, Albstadt (DE)

( * ) Notice: Subject to any disclaimer, the term of this patent is extended or adjusted under 35 U.S.C. 154(b) by 0 days.

(21) Appl. No.: 12/457,145

(22) Filed: Jun. 2, 2009

(65) Prior Publication Data

US 2009/0301138 A1 Dec. 10, 2009

(30) Foreign Application Priority Data

Jun. 4, 2008 (EP) ..... 08157584

(51) Int. Cl.
*D04B 15/06* (2006.01)

(52) U.S. Cl. ..... 66/106

(58) Field of Classification Search ..... 66/64, 104, 66/109, 106

See application file for complete search history.

(56) References Cited

U.S. PATENT DOCUMENTS

| | | | | | |
|---|---|---|---|---|---|
| 1,339,708 | A | * | 5/1920 | Lippitt | 66/66 |
| 3,754,416 | A | * | 8/1973 | Apprich | 66/106 |
| 4,574,596 | A | * | 3/1986 | Engelfried et al. | 66/104 |
| 4,713,948 | A | * | 12/1987 | Schmidt et al. | 66/106 |
| 5,134,865 | A | * | 8/1992 | Shima et al. | 66/106 |
| 5,138,849 | A | * | 8/1992 | Stoll et al. | 66/104 |
| 5,231,854 | A | * | 8/1993 | Schmid et al. | 66/64 |
| 5,244,141 | A | * | 9/1993 | Doolittle | 228/160 |
| 5,333,473 | A | * | 8/1994 | Miyamoto | 66/106 |
| 5,408,849 | A | * | 4/1995 | Schimko et al. | 66/106 |
| 5,475,991 | A | * | 12/1995 | Yabuta et al. | 66/106 |
| 5,570,592 | A | * | 11/1996 | Takegawa | 66/64 |
| 5,918,483 | A | * | 7/1999 | Schmid et al. | 66/64 |
| 6,014,874 | A | * | 1/2000 | Shima et al. | 66/106 |

FOREIGN PATENT DOCUMENTS

| | | | |
|---|---|---|---|
| DE | 1 087 743 | | 2/1961 |
| DE | 2545212 | A1 * | 4/1977 |
| DE | 39 17 934 | | 12/1989 |
| DE | 31 08 041 | | 10/2001 |
| EP | 0 567 282 | | 9/1997 |
| EP | 0 857 802 | | 8/1998 |
| FR | 1207319 | | 2/1960 |

* cited by examiner

*Primary Examiner* — Danny Worrell
(74) *Attorney, Agent, or Firm* — Fitch, Even, Tabin & Flannery; Norman N. Kunitz

(57) ABSTRACT

A knitting system (6) wherein said system causes a rocker guide (23) to move the holding-down and knock-over sinker 5 as a function of the longitudinal position of the knitting needle (4). Consequently, the pivoting movement of the holding-down and knock-over sinker (5) is forced to follow the back-and-forth linear movement of the knitting needle (4). A single box cam is sufficient for controlling this knitting system (6). In any event, it is only necessary to allocate box cams to the knitting needles (4). The holding-down and knock-over sinkers (5) do not require dedicated drives and box cams.

10 Claims, 4 Drawing Sheets

NEEDLE-DRIVE KNOCK-OVER SINKER

CROSS-REFERENCE TO RELATED APPLICATION

This application claims the benefit of foreign priority under 35 U.S.C. §119 based on European 08 157 584.7, filed Jun. 4, 2008, the entire disclosure of which application is hereby incorporated by reference.

BACKGROUND OF THE INVENTION

The invention relates to a holding-down and knock-over sinker, a knitting system comprising such a holding-down and knock-over sinker, as well as to a knitting machine comprising such a knitting system.

Knitting systems frequently comprise at least one knitting needle, for example, in the form of a latch needle, as well as a sinker that participates in the knitting process and, for example, is intended to hold the knit fabric in place or in a specific position during stitch formation. To do so, the needle and the sinker perform a relative movement in the course of which the needle, as well as the sinker, are being moved. This has been known from prior art.

DE 31 08 041 C2 discloses a circular knitting machine with knitting systems that comprise a holding-down and knock-over sinker and a knitting needle. The knitting systems are arranged in a needle bed that is designed as a knitting cylinder. The knitting needles, as well as the holding-down and knock-over sinkers are subject to movement. In order to generate this movement, the knitting needle and the holding-down sinker each have a foot that communicates with its own box channel. Consequently, the holding-down and knock-over sinker, as well as the knitting needles, are primarily driven so as to move back and forth, i.e., they are driven in longitudinal direction. The holding-down and knock-over sinker has a projection that is supported on an inclined surface of its sinker channel, as a result of which its longitudinal movement is partially converted into an up-and-down directed transverse movement.

The desired relative movement between the sinker and the needle is defined by the shape of the needle bed, in particular by the inclined surface provided there. In addition, a cam having at least two box cams is necessary—one for the knitting needle and one for the holding-down and knock-over sinker.

Considering this, it is the object of the invention to provide a knitting system and its associate components, said knitting system being improved at least in view of one of the mentioned aspects.

SUMMARY OF THE INVENTION

The above object generally is achieved with the holding-down and knock-over sinker in accordance with the invention. The advantages connected with the holding-down and knock-over sinker are particularly obvious with the use of the holding-down and knock-over sinker in the system in accordance with the invention and with the use of this knitting system in a knitting machine:

The holding-down and knock-over sinker in accordance with the invention is provided with a device that establishes a driven connection between said sinker and the knitting needle. This device effects a transmission of motion and force between the movement of the knitting needle and the movement of the holding holding-down sinker. The device couples the movement of the holding-down and knock-over sinker to the movement of the knitting needle and thus uses the knitting needle as the drive for the holding-down and knock-over sinker. In the broadest terms, the device that establishes the driven connection between the knitting needle and the holding-down and knock-over sinker represents a transmission. For example, the components of the holding-down and knock-over sinker or sections thereof, and parts or sections of the knitting needle act as transmission elements that are in direct contact with each other or are in motion-transmitting contact with each other due to the interposition of additional elements.

As a result of this measure, a separate drive for the holding-down and knock-over sinker can be omitted. The knitting system composed with this holding-down and knock-over sinker requires only one exterior drive that interacts with the knitting needle. This drive may be a cam path of a knitting cam assembly associated with the knitting needle. The movement of the holding-down and knock-over sinker results from the movement of the knitting needle. Consequently, owing to the invention, it is possible to substantially simplify the design of the knitting cam assembly of the knitting machine.

Also, the movement of the holding-down and knock-over sinker is not dependent on the design of the bottom of the sinker channel. A change of the path of movement or the curvature of the holding-down and knock-over sinker relative to the path of movement of the curvature of the knitting needle does not require a change on the needle and sinker bed. For example, it is sufficient to change the holding-down and knock-over sinkers and/or the knitting needles or the boxcar.

Preferably, the holding-down and knock-over sinker is supported on the needle bed, for example, in that said holding-down and knock-over sinker is fixed in position relative to the longitudinal or output movement of the needle and does not also perform this movement. The resultant relative movement between the needle and the holding-down and knock-over sinker can be utilized to generate a transverse movement of the holding-down and knock-over sinker relative to the needle. In principle, this transverse movement may be a linear movement; however, in the simplest case said movement is the component of a pivoting movement, thus substantially simplifying the support and guiding of the holding-down and knock-over sinker. Consequently, the holding-down and knock-over sinker is preferably supported so as to be pivotable. The pivotable support is implemented, for example, by a pivot bearing that defines a pivot axis extending transversely to the knitting needle. Preferably, the pivot axis is aligned approximately at a right angle relative to the flat sides of the holding-down and knock-over sinker as well as to the flat sides of the knitting needle.

Preferably, the holding-down and knock-over sinker has a curved knock-over edge. The latter may be or may have a curvature profile for controlling the position of a half-stitch picked up by the knitting needle. This profile may have—in sections—a constant radius and thus a constant curvature relative to the pivot axis of the holding-down and knock-over sinker. It is also possible to provide changing curvatures in order to impart the knit fabric with an additional motion component (contrary movement) directed against the movement of the knitting needle, for example. As a result of this opposing or contrary movement, the needle stroke may be abbreviated, which has far-reaching effects on the knitting system and the knitting machine. An abbreviation of the needle movement may provide the basis for an increase of the knitting speed, for the size reduction of the knitting machine and for the simplification of the design.

Preferably, the holding-down and knock-over sinker has a slit-like recess forming a holding-down space for the half-stitches and/or the knit fabric. This holding-down space is formed between a holding-down edge and a section of the knock-over edge. Above the slit, the sinker has a bill. The shape of the bill is adapted to the rotary movement of the holding-down and knock-over sinker in such a manner that half-stitches are safely speared by the needle shaft, without the risk of said half-stitches potentially sliding into this knock-over space. To achieve this, the bill of the holding-down and knock-over sinker may have a chamfered section in its front region of the holding-down edge. With the use of this inclined inlet region, a half-stitch located on the needle shaft can be safely grasped by the holding-down and knock-over sinker and received by the holding-down space.

In the simplest case, the power-transmitting device between the holding-down and knock-over sinker and the needle may be designed as a cam guide that comprises at least one guide cam on the holding-down and knock-over sinker and that comprises a guide element connected to the knitting needle. When the knitting needle is being moved, this element moves along the guide can and, in so doing, adjusts the pivot position of the holding-down and knock-over sinker. The holding-down and knock-over sinker can be biased in a pivoting direction by means of a suitable biasing means such as, for example, a spring, so that the guide cam and the guide element remain in engagement with each other.

Referring to a preferred embodiment, the guide cam, however, is part of a rocker guide that may be formed by a longitudinal slit-like recess in the holding-down and knock-over sinker. This slit-like recess is preferably arranged in such a manner that it has—along its length—different radii relative to the pivot axis of the holding-down and knock-over sinker. In the simplest case the rocker guide is formed by a curved slit that is provided in the holding-down and knock-over sinker. Then the knitting needle features as the guide element, for example, a pin that extends laterally from the knitting needle, said pin coming into engagement with this rocker. A forward or reverse movement of the knitting needle thus effects a back or forth pivoting of the holding-down and knock-over sinker. The pin of the knitting needle may then be the slide block that comes directly into engagement with the flanks of the rocker. Alternatively, shock-reducing or wear-minimizing intermediate elements may also be provided such as, for example, sliding shoes or the like seated on the pin.

The knitting system that comprises at least one holding-down and knock-over sinker and at least one knitting needle may be arranged in a common channel of a needle and sinker bed. In so doing, the holding-down and knock-over sinker and the knitting needle may be flat side against flat side. The pivot bearing for the holding-down and knock-over sinker may be provided on the strip walls of the needle and sinker bed. In order to achieve the greatest possible play considering the pivoting of the holding-down and knock-over sinkers the needle and sinker slits may be provided on their sinker-side end with the perforated bottom.

Considering a preferred embodiment of the holding-down and knock-over sinker, said holding-down and knock-over sinker is provided—adjoining its knock-over edge—with a section in which its body displays reduced thickness. Preferably, its flat side abutting against the needle during operation is provided with a step. The section of the lateral surface facing the knitting needle and adjoining the knock-over edge thus no longer directly abuts against the lateral surface of the knitting needle. Rather, it includes a distance therewith. If the distance is big enough, this leads to an considerable symmetrization of the knitting system. If two adjacent knitting systems and their knitting needles are viewed, the knock-over edge of the holding-down and knock-over sinker located between the knitting needles are centered or largely centered between the knitting needles. Therefore, varying tensile stresses on the legs of a machine and miscellaneous disadvantageous effects are avoided. Instead of a one-sided offset in the form of a step on the holding-down and knock-over sinker it is also possible to provide the holding-down and knock-over sinker with an appropriate offset, whereby the thickness of the holding-down and knock-over sinker is then uniform. However, it is also possible to combine the thickness reduction in the region of the knock-over edge with a lateral offset of the holding-down and knock-over sinker.

Additional details of advantageous embodiments of the invention are the subject matter of subclaims, the description and/or the drawings. The description is restricted to essential aspects of the invention and miscellaneous situations. The drawings disclose additional details and are to be referred to as being supplementary.

DETAILED DESCRIPTION OF THE INVENTION

Figure 1:
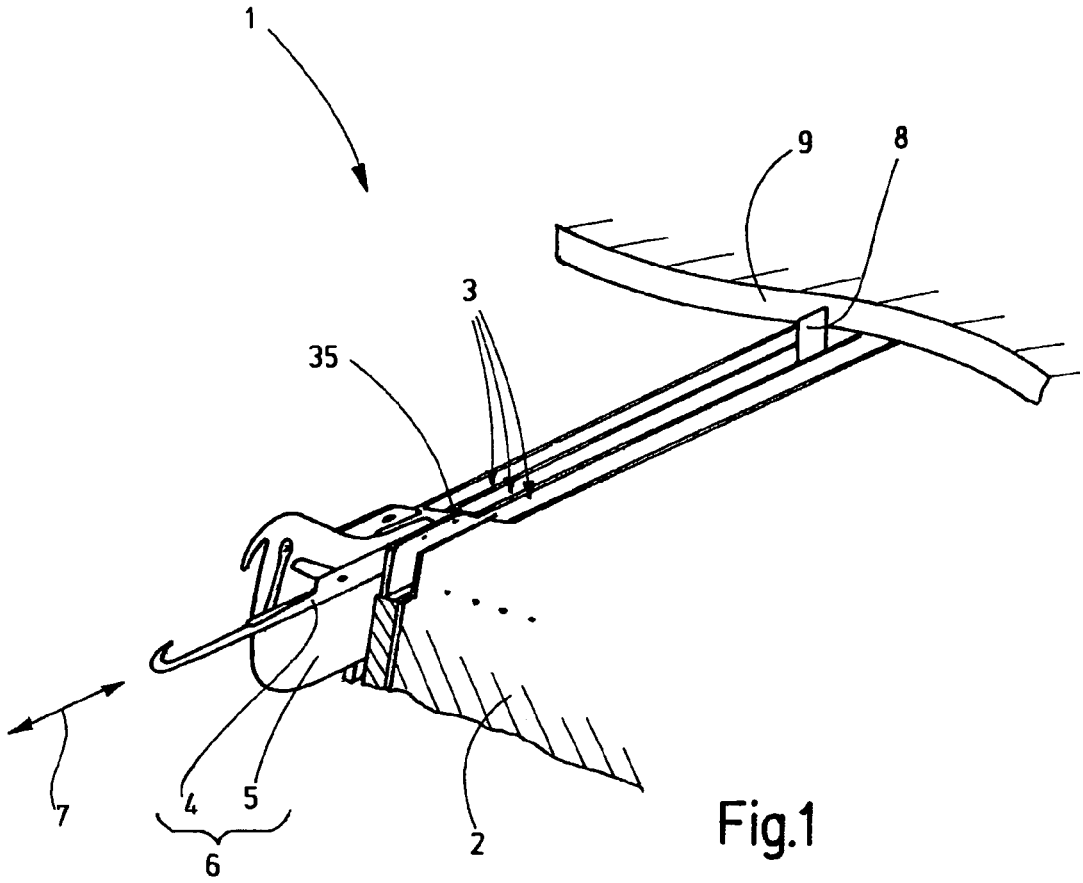
FIG. 1 is a perspective illustration of a section of a knitting machine comprising a holding-down and knock-over sinker in accordance with the invention, said sinker belonging to a knitting system in accordance with the invention.

FIG. 1 is a highly schematic view of a detail of a knitting machine 1. This detail includes a needle and sinker bed 2 that comprises, for example, a knitting cylinder, a circular knitting machine, a rib dial or the like. The needle and sinker bed 2 has a number of channels 3, each being disposed to accommodate knitting needles as well as holding-down and knock-over sinkers. FIG. 1 illustrates such a knitting needle 4, as well as such a holding-down and knock-over sinker 5 that, together, form a knitting system 6. This knitting system 6 is now driven by a longitudinal movement of the knitting needle 4 as symbolically illustrated by an arrow 7 in FIG. 1. In order to impart the knitting needle 4 with a targeted back and forth movement, said needle is provided with a foot 8 that is in abutment with a so-called box cam. A relative movement between the needle and sinker bed 2 and the box cam 9 causes the foot sliding along the box cam to be shifted back and forth consistent with the slope of the box cam 9 in the direction of the arrow 7, thus causing the knitting needle 4 to be driven.

Figure 2:
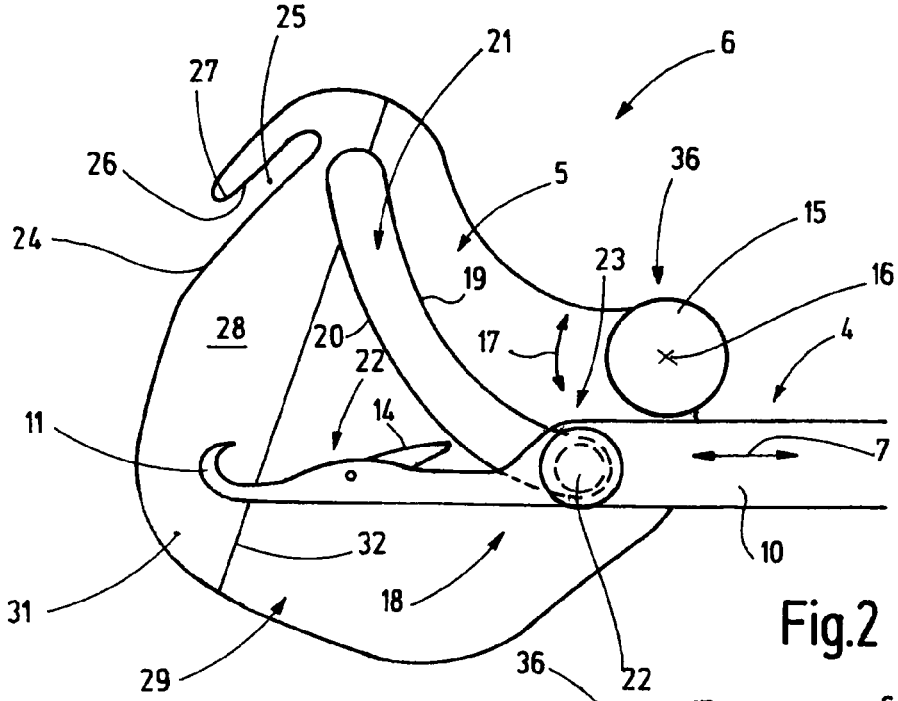
FIG. 2 is a schematic side view of the knitting system in accordance with FIG. 1 in a first position.
Figure 3:
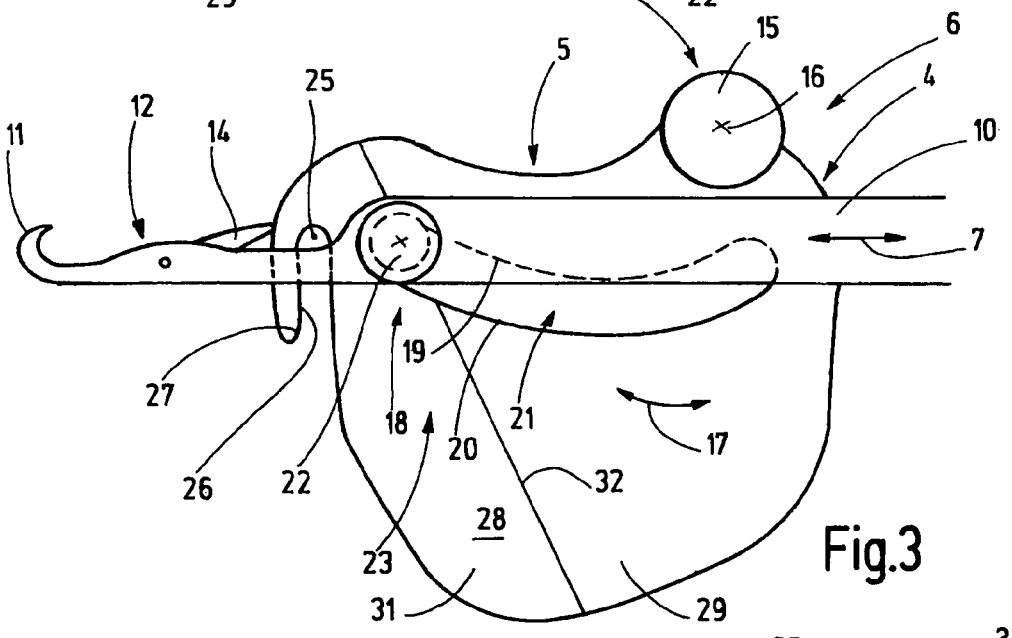
FIG. 3 illustrates the knitting system in accordance with FIG. 2 in another relative position.
Figure 4:
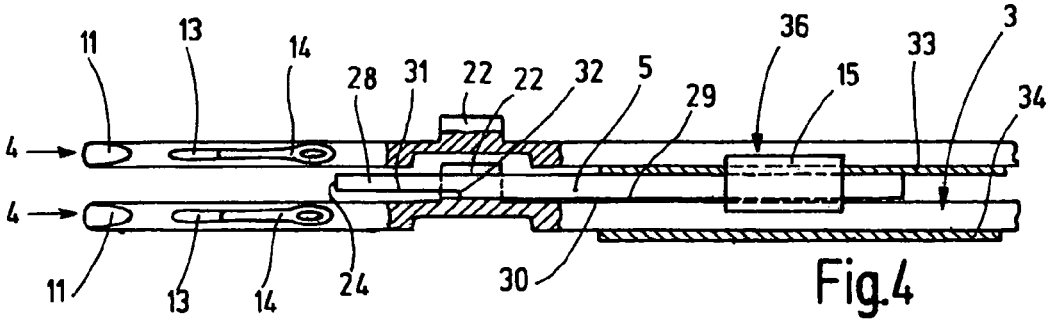
FIG. 4 is a plan view of a detail of the needle bed of the knitting machine in accordance with FIG. 2.

FIGS. 2 through 4 provide a more detailed and better understanding of the knitting needle 4. It has a shank 10 that is provided with a hook 11 on one end. The needle breast 12 rises in the vicinity of the hook 11, said needle breast being provided with a latch slit 13 and a latch 14 that is pivotally supported therein.

The holding-down and knock-over sinker 5 is a flat, preferably almost planar component of sheet metal that is supported on a support device 15 so as to be pivotable about a pivot axis 16 that is aligned transversely to the knitting needle. The support devices 15 of the various knitting systems 6 consist, for example, of pins that are seated in bores or recesses of the strip walls that delimit the channels 3. Preferably, the pivot axes 16 of the individual support devices 5 correspond to each other with at most a minimal angular deviation (considering round needle beds such as knitting cylinders or rib dials). While the knitting needle 4 may carry out a linear movement in the direction of the arrow 7, the holding-down and knock-over sinker 5 may carry out a pivoting movement in the direction of the arrow 17.

A device 18 is used for driving the holding-down and knock-over sinker, which device can also be viewed as a transmission. The device comprises at least one, preferably however two cam paths 19, 20 that may be formed by the flanks of a slit 21 provided in the holding-down and knock-over sinker 5. Preferably the cam paths 19, 20, i.e., the slit flanks are aligned—irrespective of a potential curvature of the slit 21—approximately parallel with respect to each around the axis of rotation 16, i.e., the slit width has preferably the same dimensions at each point of the slit.

The knitting needle 4 has a lateral projection, for example, configured as a pin 22 that is affixed or molded to the knitting needle 4. The pin 22 extends through the slit 21 or, at least, extends into said slit. The size of the diameter of the pin is slightly smaller than the distance between the cam paths 19, 20. In so doing, the pins 22 and the cam paths 19, 20 and the slit 21, respectively, form a rocker guide 23 that is disposed to convert the linear movement of the knitting needle 4 into a pivoting movement of the holding-down and knock-over sinker 5. This is achieved in that the distance of the cam path 19 from the pivot axis 16 varies over the length of the cam path 19.

The holding-down and knock-over sinker 5 has a knock-over or couliering edge 24 that curves around the pivot axis 16. The couliering edge 24 may have straight and curved sections. In the simplest case, the couliering edge has the contour of a circular arc with the pivot axis 16 being said couliering edge's center. This couliering edge 24 represents the knock-over edge for the stitch formation. In addition, a receiving space 25 is provided on this couliering edge 24, said space also being referred to as the holding-down space. The receiving space 25 is delimited by the knock-over edge 24, on the one side, and by the downholder edge 26, on the other side, said downholder edge extending on the side of the bill facing the couliering edge 24 at a distance from said edge.

As already mentioned, the knock-over edge 24 may be configured as a circular arc and thus display a constant curvature. Alternatively, as shown by FIGS. 2 and 3, the couliering edge 24 may also have alternating curvatures. In so doing the stitch formation can be enhanced because a relative movement between a stationary reference point and the couliering edge 24, said movement also being referred to as a contrary movement, also takes place when the knock-over sinker 5 is being pivoted. This relative movement occurs essentially contrary to (opposing) the needle movement, as a result of which the needle stroke can be abbreviated.

The shape of the bill is adapted to the rotary movement of the holding-down and knock-over sinker 5 in such a manner that half-stitches can securely slide into this receiving space, without being speared. To accomplish this, the bill of the sinker may have a slanted section in its wider front region 27 of the downholder edge 26. With the use of this slanted inlet section, a half-stitch located on the needle shank can be safely grasped by the sinker and guided into the receiving space 25. The slanted section 27 forms a funnel-shaped expansion of the receiving space 25 on one side.

As is obvious from Figure, in particular, the holding-down and knock-over sinker 5 may have a reduced thickness in the region 28 adjoining the couliering edge 24. While the flat, preferably planar lateral surface 29 of the holding-down and knock-over sinker 5 otherwise abuts against the essentially planar lateral surface 30 of the knitting needle 4 (see FIG. 4), the lateral surface 31 of the region 28 facing the knitting needle 4 maintains a distance from the lateral surface 30. The lateral surfaces 29, 31 are separated from each other by a step 32. Additionally or alternatively, the region 28 may be provided with an offset. As is obvious from FIG. 4, the objective of the measure is to place the couliering edge 24 approximately centered between the adjacent knitting needles 4, even though the holding-down and knock-over sinker 5, as can be seen on the right of FIG. 4, is positioned asymmetrically between the knitting needles 4. As is obvious, the knitting system 6—comprising the holding-down and knock-over sinker 5 and the knitting needle 4 together—is arranged in the channel 3 that is delimited by the strip walls 33, 34. The bottom of the channel 3 delimited by the strip walls 33, 34 may be perforated (or have a slit) at the holding-down and knock-over sinker 5 in order to make it possible for the sinker to be freely pivoted in downward direction. This is indicated in FIG. 1. In so doing, the installation space for the pivot sinker is created in that the channels 3 are fully slit in the pivot region of the sinker, i.e., in the upper region of a knitting cylinder the channel bottom is omitted altogether. However, should the division of the knitting cylinder permit this, it is possible to also fully slit only that region of the needle channel that accommodates the holding-down and knock-over sinker 5 that is to be pivoted, so that the adjacent knitting needles 4 are supported and guided up to just before their stitch-forming regions, as is indicated in FIG. 1.

The holding-down and knock-over sinker 5 is supported in corresponding recesses of the strip walls 33, 34. As is shown by FIG. 1, each of them may have an upward directed projection 35. This projection 35 accommodates the support device 15. The support may, for example, be open toward the outside of the knitting cylinder. Consequently, it is possible, for example, to easily insert a pin 36 connected to the holding-down and knock-over sinker 5, said pin representing the support device (FIGS. 2 through 4). The pin 36 in the receptacle can be secured by a spiral spring, securing clips, etc. Alternatively, the projection 35 may have a closed receiving bore for the pin 36 of the holding-down and knock-over sinker 5 and also display a certain lateral elasticity. When the holding-down and knock-over sinker 5 is installed, the projection 35 is bent in a slightly elastic manner to the side, so that the pin 36 may be located in the appropriate opening.

Figures 5, 6, 7:
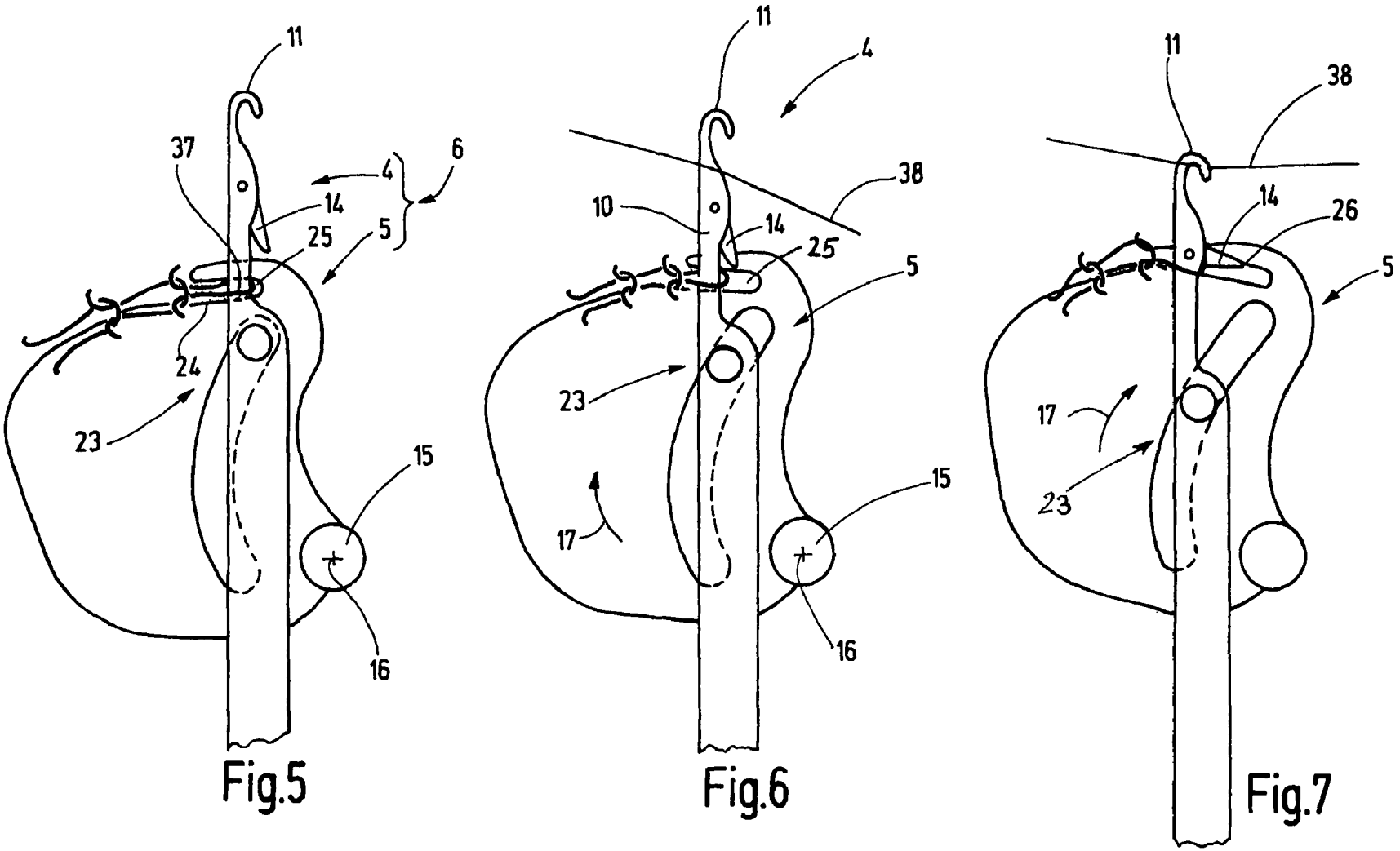
FIGS. 5 through 10 are a schematic side view of the inventive knitting system in various stages of a stitch-forming process.

In accordance with FIGS. 5 through 10, the knitting system 6 described so far works as follows:

FIG. 5 shows the starting position in which the knitting needle is completely driven out of the channel 3. The half-stitch 37 located behind its latch 14 is held in the receiving space 25 of the holding-down and knock-over sinker.

FIG. 6 shows the insertion of an additional thread 38 at the start of the return stroke of the knitting needle 4. Whereas the rocker guide 23 in the position in FIG. 5 would have displaced the holding-down and knock-over sinker into its maximum position in counterclockwise direction, the starting return stroke of the knitting needle 4 in accordance with FIG. 6 causes the holding-down and knock-over sinker 35 to begin to rotate in clockwise direction, i.e., in such a manner that the receiving space 25 is enlarged and the bill of the holding-down and knock-over sinker 5 is just in front of it, thus clearing the shank 10.

FIG. 7 shows the continued movement. The return stroke of the knitting needle 4 was transmitted via the rocker guide 23 to the holding-down and knock-over sinker in such a manner that the downholder edge 26 releases the half stitch 37. The latch 14 begins its closing movement, and the holding-down and knock-over sinker 5 continues its pivoting movement. The half stitch 37 that is located on the needle shank 10 slides situated on the couliering edge 24 of the holding-down and knock-over sinker 5 in the direction of the hook 11 and, in so doing, closes the latch more and more, thus eventually achieving the position in accordance with FIG. 8.

Figures 8, 9, 10:
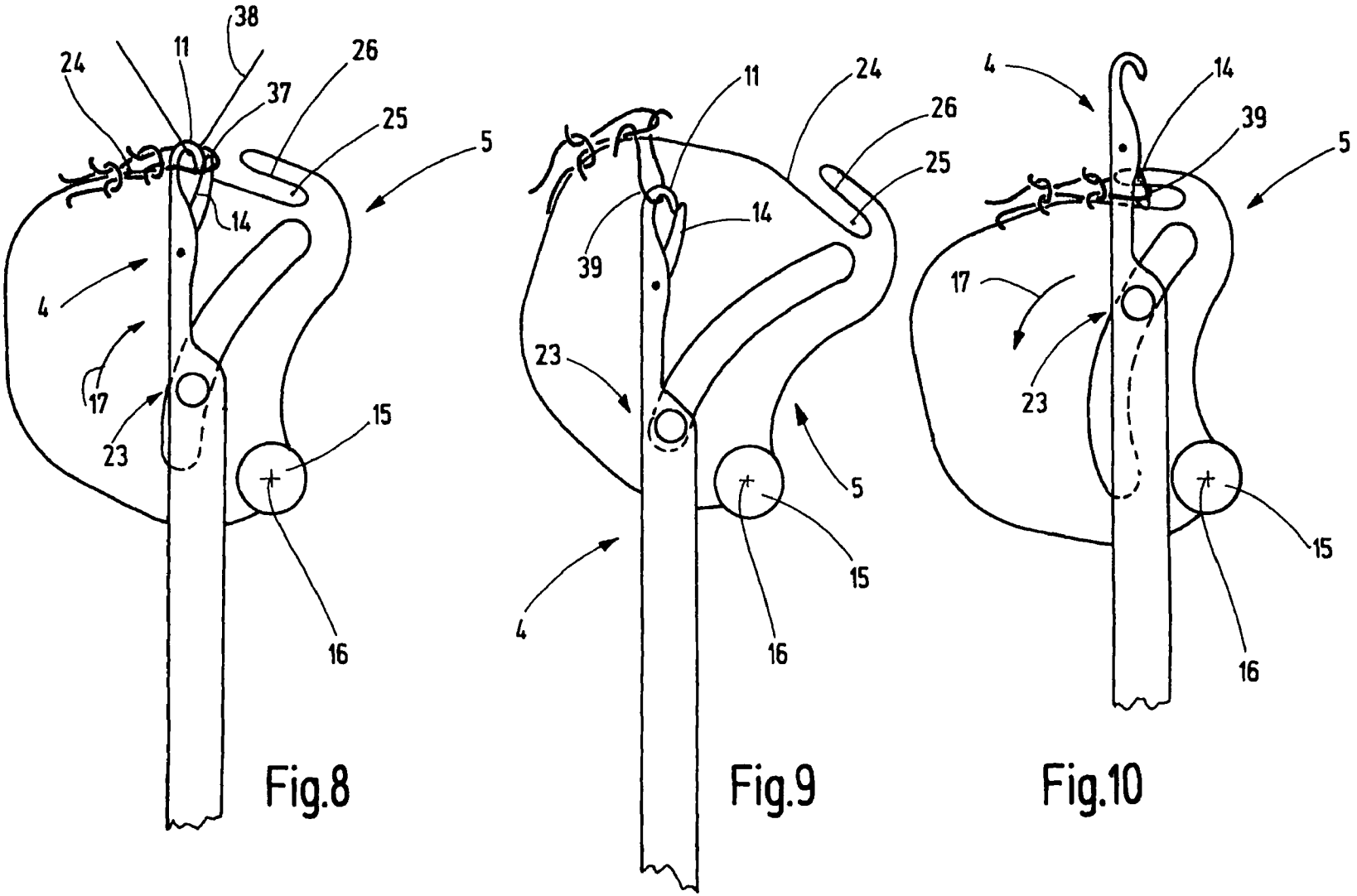

In accordance with FIG. 8, the knitting needle 4 continues its retraction movement, whereby the old half stitch 37 slides over the back of the closed latch 14 until said half stitch is finally cast off as a stitch. Enclosed in the hook 11 of the knitting needle 4 is a new half-stitch 39 (FIG. 9). The holding-down and knock-over sinker 5 has fully released the knit fabric. It is now held only by the hook 11.

FIG. 9 illustrates the couliering process. The knitting needle moves into its lowest position. In so doing, the length of the half-stitch 39 and the subsequent stitch, respectively, is defined. This results from the distance of the inner curve of the hook 11 relative to the couliering edge 24. As a result of the bulge-shaped contour of the illustrated holding-down and knock-over sinker 5, the couliering edge 24 moves away from the hook 11, so that the desired stitch length is created by a relatively short needle stroke. This needle stroke may be shorter than in the case of solutions using a couliering edge that does not move in longitudinal direction of the needle. Without the bulge-shaped contour of the couliering edge 24 the needle 4 would have to be retracted further into the channel 3 in order to form the same stitch length. This would have the result that larger box cams are necessary, which, in turn, may reduce the number of systems (knitting systems) on the needle cylinder.

FIG. 10 illustrates the catch position. In so doing, the knitting needle 4 again moves out of its channel 3 until the half-stitch 37 opens the latch 14 and slides over the latch 14. Due to the movement of the knitting needle 4, the holding-down and knock-over sinker 15 has again assumed its holding-down position, i.e., it was pivoted counterclockwise in the direction of the arrow 17. Before long, the starting position in accordance with FIG. 5 is reached again.

In accordance with the invention, a knitting system 6 is being suggested, said system causing a rocker guide 23 to move the holding-down and knock-over sinker 5 as a function of the longitudinal position of the knitting needle 4. Consequently, the pivoting movement of the holding-down and knock-over sinker 5 is forced to follow the back-and-forth linear movement of the knitting needle 4. A single box cam is sufficient for controlling this knitting system 6. In any event, it is only necessary to allocate box cams to the knitting needles 4. The holding-down and knock-over sinkers 5 do not require dedicated drives and box cams.

It will be appreciated that the above description of the present invention is susceptible to various modifications and changes, and the same are intended to be comprehended within the meaning and range of equivalents of the appended claims.

LIST OF REFERENCE NUMERALS

1 Knitting machine
2 Needle and sinker bed
3 Channels
4 Knitting needle
5 Holding-down and knock-over sinker
6 Knitting system
7 Arrow
8 Foot
9 Boxcam
10 Shank
11 Hook
12 Needle breast
13 Latch slit
14 Latch
15 Support device
16 Pivot axis
17 Arrow
18 Device
19, 20 Cam paths
21 Slit
22 Pin
23 Rocker guide
24 Couliering edge
25 Receiving space
26 Downholder edge
27 Section
28 Region
29, 30, 31 Lateral surfaces
32 Step
33, 34 Strip walls
35 Projection
36 Pin
37 Half-stitch
38 Thread
39 Half-stitch

What is claimed is:

1. Knitting system comprising: a holding-down and knock-over sinker; at least one knitting needle connectable to a drive means; and a means, connecting the needle to the sinker, for creating a driving connection between the knitting needle and the holding-down and knock-over sinker to transmit movement of the needle to the sinker to produce movement of the sinker, and wherein the means for creating is configured as a cam guide that comprises at least one guide curve provided on the holding-down and knock-over sinker and a guide element connected to the knitting needle.

2. Knitting system in accordance with claim 1, wherein the sinker is provided with a support device for the pivotable support of the sinker on a needle bed.

3. Knitting system in accordance with claim 1, wherein the sinker has a flat body that is provided with a knock-over edge.

4. Knitting system in accordance with claim 3, wherein the sinker is provided with a support device for the pivotable support of the sinker on a needle bed, and the knock-over edge has a curved profile for controlling a position of a half-stitch that has been taken up by the knitting needle.

5. Knitting system in accordance with claim 1, wherein the sinker has a slit that forms an enclosing space.

6. Knitting system in accordance with claim 1, wherein the cam guide is part of a rocker guide, and the guide element is a slide block.

7. Knitting system in accordance with claim 3, wherein, adjoining its knock-over edge, said sinker has a section where its body displays reduced thickness.

8. Knitting system in accordance with claim 1, wherein the holding-down and knock-over sinker and the knitting needle abut against each other along flat lateral surfaces.

9. Knitting machine with a knitting system in accordance with claim 8, wherein:

the holding-down and knock-over sinker and the knitting needle are arranged in a common needle channel of a needle bed, the knitting machine has a box cam for controlling the movement of the knitting needle and, the movement of the holding-down and knock-over sinker is exclusively a function of the movement of the knitting needle due to the means for creating a driving connection between the knitting needle and the holding-down and knock-over sinker.

10. Knitting machine comprising:

a knitting system including a holding-down and knock-over sinker; at least one knitting needle; and a means, connecting the needle to the sinker, for creating a driving connection between the knitting needle and the holding-down and knock-over sinker to transmit movement of the needle to the sinker to produce movement of the sinker, and wherein the holding-down and knock-over sinker and the knitting needle abut against each other along flat lateral surfaces, the holding-down and knock-over sinker and the knitting needle are arranged in a common needle channel of a needle bed, the knitting machine has a box cam for controlling the movement of the knitting needle and, the movement of the holding-down and knock-over sinker is exclusively a function of the movement of the knitting needle due to the means for creating a driving connection between the knitting needle and the holding-down and knock-over sinker.

* * * * *